US012448670B2

(12) United States Patent
Kido et al.

(10) Patent No.: US 12,448,670 B2
(45) Date of Patent: Oct. 21, 2025

(54) CEMENTED CARBIDE

(71) Applicant: Sumitomo Electric Industries, Ltd., Osaka (JP)

(72) Inventors: Yasuki Kido, Osaka (JP); Yoshihiro Kimura, Osaka (JP); Anongsack Paseuth, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/714,586

(22) PCT Filed: Sep. 26, 2023

(86) PCT No.: PCT/JP2023/035011
§ 371 (c)(1),
(2) Date: May 30, 2024

(87) PCT Pub. No.: WO2025/069215
PCT Pub. Date: Apr. 3, 2025

(65) Prior Publication Data

US 2025/0101548 A1 Mar. 27, 2025

(51) Int. Cl.
*C22C 29/06* (2006.01)
*C22C 29/08* (2006.01)

(52) U.S. Cl.
CPC ..... *C22C 29/067* (2013.01); *C22C 29/08* (2013.01)

(58) Field of Classification Search
CPC ..... C22C 29/067; C22C 29/08
See application file for complete search history.

(56) References Cited

U.S. PATENT DOCUMENTS

| | | | | |
|---|---|---|---|---|
| 6,514,456 | B1 | 2/2003 | Lackner et al. | |
| 2012/0114960 | A1 | 5/2012 | Takesawa et al. | |
| 2019/0345589 | A1 | 11/2019 | Konyashin et al. | |
| 2021/0370371 | A1 * | 12/2021 | Ohata | C22C 38/56 |

FOREIGN PATENT DOCUMENTS

| | | | | |
|---|---|---|---|---|
| EP | 3147377 | A1 | 3/2017 | |
| JP | 2004-131769 | A | 4/2004 | |
| JP | 2006-037160 | A | 2/2006 | |
| JP | 7131738 | B1 * | 9/2022 | C22C 29/005 |
| WO | 2011/002008 | A1 | 1/2011 | |
| WO | 2015/178484 | A1 | 11/2015 | |

OTHER PUBLICATIONS

JP7131738B1 machine translation (Year: 2022).*
International Search Report and Written Opinion mailed on Dec. 12, 2023, received for International Application No. PCT/JP2023/035011, filed on Sep. 26, 2023, 14 pages including English Translation.

* cited by examiner

*Primary Examiner* — Amber R Orlando
*Assistant Examiner* — Cameron K Miller
(74) *Attorney, Agent, or Firm* — XSENSUS LLP

(57) ABSTRACT

Provided is a cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume or more and 20.0% by volume or less of the binder phase, the binder phase contains cobalt, the cemented carbide contains 1.0% by mass or more of cobalt, and a percentage (H2/H1)×100 of a hardness of the binder phase at 600° C., H2 GPa, to a hardness at 25° C., H1 GPa, as measured by a nanoindenter method is 25% or more.

6 Claims, 1 Drawing Sheet

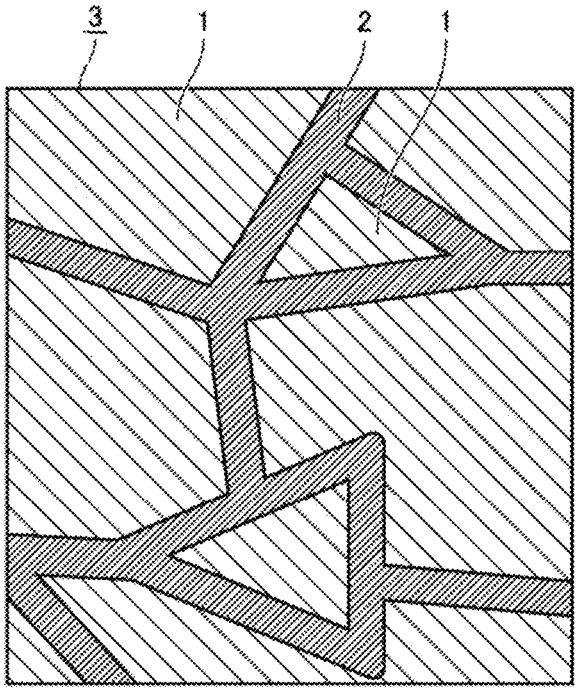
3
1
2
1

CEMENTED CARBIDE

CROSS-REFERENCE TO RELATED APPLICATION

The present application is a national stage application, pursuant to 35 U.S.C. § 371, of International Patent Application No. PCT/JP2023/035011, filed Sep. 26, 2023, the entire contents of which are incorporated herein by reference.

TECHNICAL FIELD

The present disclosure relates to a cemented carbide.

BACKGROUND ART

Conventionally, cemented carbides comprising a plurality of tungsten carbide grains and a binder phase have been utilized as materials for cutting tools (PTL 1).

CITATION LIST

Patent Literature

PTL 1: Japanese Patent Laying-Open No. 2004-131769

SUMMARY OF INVENTION

A cemented carbide of the present disclosure is a cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume or more and 20.0% by volume or less of the binder phase, the binder phase contains cobalt, the cemented carbide contains 1.0% by mass or more of cobalt, and a percentage (H2/H1)×100 of the hardness of the binder phase at 600° C., H2 GPa, to the hardness at 25° C., H1 GPa, as measured by a nanoindenter method is 25% or more.

BRIEF DESCRIPTION OF DRAWING

FIG. 1 is a diagram schematically showing one cross-section of a cemented carbide of one embodiment of the present disclosure.

DETAILED DESCRIPTION

Problem to be Solved by the Present Disclosure

In recent years, workpieces have become increasingly difficult to cut in cutting processes, and the conditions under which cutting tools are used have become more severe. Therefore, improvement of various characteristics has also been demanded for cemented carbides used as base bodies for cutting tools. There has been a demand for a cemented carbide that enables a longer service life of tools, even in the case where it is used as a material for cutting tools for high speed processing of materials with particularly high hardness.

Therefore, an object of the present disclosure is to provide a cemented carbide that enables a longer service life of tools, even in the case where it is used as a material for cutting tools for high speed processing of materials with particularly high hardness.

Advantageous Effect of the Present Disclosure

According to the present disclosure, it is possible to provide a cemented carbide that enables a longer service life of tools, even in the case where it is used as a material for cutting tools for high speed processing of materials with particularly high hardness.

DESCRIPTION OF EMBODIMENTS

First, embodiments of the present disclosure will be listed and described.

(1) A cemented carbide of the present disclosure is a cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume or more and 20.0% by volume or less of the binder phase, the binder phase contains cobalt, the cemented carbide contains 1.0% by mass or more of cobalt, and the percentage (H2/H1)×100 of the hardness of the binder phase at 600° C., H2 GPa, to the hardness at 25° C., H1 GPa, as measured by a nanoindenter method is 25% or more.

According to the present disclosure, it is possible to provide a cemented carbide that enables a longer service life of tools, even in the case where it is used as a material for cutting tools for high speed processing of materials with particularly high hardness.

(2) In the above (1), the percentage (H2/H1)×100 may be 50% or more. As a result of this, it is possible to provide a cemented carbide that can further extend the tool life of cutting tools, even in high speed processing of materials with particularly high hardness.

(3) In the above (1) or (2), the hardness H1 may be 7.0 GPa or more. As a result of this, it is possible to provide a cemented carbide that can further extend the tool life of cutting tools, even in high speed processing of materials with particularly high hardness.

(4) In any of the above (1) to (3), the binder phase may further contain a first element, and the first element may be at least one element selected from the group consisting of silicon, phosphorus, germanium, tin, rhenium, ruthenium, osmium, iridium, and platinum. As a result of this, it is possible to provide a cemented carbide that can further extend the tool life of cutting tools, even in high speed processing of materials with particularly high hardness.

(5) In the above (4), in the binder phase, the percentage {M1/(M1+M2)}×100 of the mass M1 of the first element to the sum M1+M2 of the mass M1 of the first element and the mass M2 of cobalt may be 1% or more and 6% or less. As a result of this, it is possible to provide a cemented carbide that can further extend the tool life of cutting tools, even in high speed processing of materials with particularly high hardness.

Details of Embodiments of the Present Disclosure

Hereinafter, a specific example of a cutting tool of one embodiment of the present disclosure (hereinafter, also referred to as "the present embodiment") will be described with reference to a drawing. In the drawing of the present disclosure, the same reference signs represent the same portions or equivalent portions. In addition, dimensional relationships such as length, width, thickness, and depth are changed as appropriate for clarity and simplicity in the drawing and do not necessarily represent actual dimensional relationships.

In the present disclosure, the expression "A to B" represents a range of lower to upper limits (i.e., A or more and B or less), and in the case where no unit is indicated for A and a unit is indicated only for B, the unit of A is the same as the unit of B.

In the case where a compound or the like is expressed by a chemical formula in the present disclosure and an atomic ratio is not particularly limited, it is assumed that all the conventionally known atomic ratios are included, and the atomic ratio should not necessarily be limited only to one in the stoichiometric range.

Embodiment 1: Cemented Carbide

A cemented carbide according to one embodiment of the present disclosure will be described with reference to FIG. 1.

One embodiment of the present disclosure (hereinafter, also referred to as "the present embodiment") is

- a cemented carbide 3 comprising a plurality of tungsten carbide grains 1 and a binder phase 2,
- wherein cemented carbide 3 comprises tungsten carbide grains 1 and binder phase 2 in a total of 89% by volume or more,
- cemented carbide 3 comprises 1.8% by volume or more and 20.0% by volume or less of binder phase 2,
- binder phase 2 contains cobalt,
- cemented carbide 3 contains 1.0% by mass or more of cobalt, and
- the percentage (H2/H1)×100 of the hardness of binder phase 2 at 600° C., H2 GPa, to the hardness at 25° C., H1 GPa, as measured by a nanoindenter method is 25% or more.

According to the present disclosure, it is possible to provide cemented carbide 3 that enables a longer service life of tools, even in the case where it is used as a material for cutting tools for high speed processing of materials with particularly high hardness. The reason for this is presumed to be as follows.

Cemented carbide 3 of the present embodiment comprises plurality of tungsten carbide grains 1 (hereinafter, also referred to as "WC grains 1") and binder phase 2, and the total content of WC grains 1 and binder phase 2 in cemented carbide 3 is 89% by volume or more. According to this, cemented carbide 3 has high hardness and strength, and a cutting tool using cemented carbide 3 can have excellent abrasion resistance and breakage resistance.

Cemented carbide 3 of Embodiment 1 comprises 1.8% by volume or more and 20.0% by volume or less of binder phase 2, binder phase 2 contains cobalt, and cemented carbide 3 contains 1.0% by mass or more of cobalt. Furthermore, the percentage (H2/H1)×100 of the hardness of binder phase 2 at 600° C., H2 GPa, to the hardness at 25° C., H1 GPa, as measured by a nanoindenter method is 25% or more, and a "decrease in the hardness of cemented carbide 3" associated with the change from 25° C. conditions (in other words, room temperature conditions) to 600° C. conditions (in other words, high temperature conditions) can be suppressed. According to this, the "decrease in the hardness of cemented carbide 3" is suppressed, and a cutting tool using cemented carbide 3 can have excellent abrasion resistance, even in high speed processing of materials with particularly high hardness.

<<Composition of Cemented Carbide>>

Cemented carbide 3 comprises tungsten carbide grains 1 and binder phase 2 in a total of 89% by volume or more. As a result of this, the hardness of cemented carbide 3 can be enhanced. Cemented carbide 3 may comprise tungsten carbide grains 1 and binder phase 2 in a total of 90% by volume or more, may comprise them in a total of 91% by volume or more, or may comprise them in a total of 92% by volume or more. In cemented carbide 3, the upper limit of the total content of tungsten carbide grains 1 and binder phase 2 may be, for example, 100% by volume or less, may be 99% by volume or less, or may be 98% by volume or less. Cemented carbide 3 may comprise tungsten carbide grains 1 and binder phase 2 in a total of 90% by volume or more and 100% by volume or less, may comprise them in a total of 91% by volume or more and 100% by volume or less, or may comprise them in a total of 92% by volume or more and 100% by volume or less.

Cemented carbide 3 comprises 1.8% by volume or more and 20.0% by volume or less of binder phase 2. As a result of this, in cemented carbide 3, the hardness and toughness can be enhanced. The lower limit of the content of binder phase 2 in cemented carbide 3 may be 2.0% by volume or more, may be 3.0% by volume or more, or may be 4.0% by volume or more. The upper limit of the content of binder phase 2 in cemented carbide 3 may be 19.0% by volume or less, may be 18.0% by volume or less, or may be 17.0% by volume or less. Cemented carbide 3 may comprise 2.0% by volume or more and 19.0% by volume or less of binder phase 2, may comprise 3.0% by volume or more and 18.0% by volume or less of binder phase 2, or may comprise 4.0% by volume or more and 17.0% by volume or less of binder phase 2.

Cemented carbide 3 of Embodiment 1 can be composed of plurality of tungsten carbide grains 1 and binder phase 2. In addition to tungsten carbide grains 1 and binder phase 2, cemented carbide 3 of the present embodiment can comprise other phases (not shown). Examples of the other phases include carbides, nitrides, or carbonitrides containing at least one second element selected from the group consisting of titanium (Ti), tantalum (Ta), niobium (Nb), zirconium (Zr), hafnium (Hf), and molybdenum (Mo). The composition of the other phases is, for example, TiCN, TaC, NbC, ZrC, HfC, or $Mo_2C$.

Cemented carbide 3 of Embodiment 1 can be composed of tungsten carbide grains 1, binder phase 2, and the other phases. The content of the other phases in cemented carbide 3 is permissible to the extent that the effects of the present disclosure are not impaired. For example, the content of the other phases in cemented carbide 3 may be more than 0% by volume and 20% by volume or less, may be more than 0% by volume and 18% by volume or less, or may be more than 0% by volume and 16% by volume or less. In this case, the total content of tungsten carbide grains 1 and binder phase 2 in cemented carbide 3 may be 80% by volume or more and less than 100% by volume, may be 82% by volume or more and less than 100% by volume, or may be 84% by volume or more and less than 100% by volume.

Cemented carbide 3 of Embodiment 1 can comprise impurities. Examples of the impurities include iron (Fe), calcium (Ca), oxygen (O), and sulfur(S). The content of the impurities in cemented carbide 3 is permissible to the extent that the effects of the present disclosure are not impaired.

For example, the content of the impurities in cemented carbide 3 may be 0% by mass or more and less than 0.1% by mass. The content of the impurities in cemented carbide 3 is measured by inductively coupled plasma (ICP) emission spectroscopy (measurement device: "ICPS-8100" ™ manufactured by Shimadzu Corporation).

The method for measuring the content of tungsten carbide grains 1 in cemented carbide 3 [% by volume] and the content of binder phase 2 in cemented carbide 3 [% by volume] is as follows.

(A1) Cemented carbide 3 is cut out at an arbitrary position to expose a cross-section. The cross-section is subjected to mirror surface processing using CROSS SECTION POLISHER (manufactured by JEOL Ltd.).

(B1) The surface of cemented carbide 3 that has been subjected to the mirror surface processing is analyzed by scanning electron microscopy with energy dispersive X-ray spectroscopy (SEM-EDX) (device: "Gemini 450" ™ manufactured by Carl Zeiss AG) to identify the elements contained in cemented carbide 3.

(C1) The surface of cemented carbide 3 that has been subjected to the mirror surface processing is imaged using a scanning electron microscope (SEM) to obtain a backscattered electron image. The region to be imaged of the image taken is set at the center of the cross-section of cemented carbide 3, i.e., at a position that does not include portions where the properties clearly differ from those of the bulk portion, such as the vicinity of the surface of cemented carbide 3 (at a position where the entire region to be imaged is the bulk portion of cemented carbide 3). The observation magnification is 5000 times. The measurement conditions are an acceleration voltage of 3 kV, a current value of 2 nA, and a working distance (WD) of 5 mm.

(D1) The region to be imaged in the above (C1) is analyzed using an energy dispersive X-ray spectrometer attached to a SEM (SEM-EDX) to identify the distribution of the elements identified in the above (B1) in the region to be imaged, and an elemental mapping image is obtained.

(E1) The backscattered electron image obtained in the above (C1) is imported into a computer and subjected to a binarization process using image analysis software (OpenCV, SciPy). In the image after the binarization process, tungsten carbide grains 1 are shown in white, and binder phase 2 is shown in gray to black. Note that the threshold value of the binarization varies depending on the contrast, and is thus set for each image.

(F1) The elemental mapping image obtained in the above (D1) and the image after the binarization process obtained in the above (E1) are overlapped, thereby identifying the respective regions where tungsten carbide grains 1 and binder phase 2 are present on the image after the binarization process. Specifically, the region shown in white in the image after the binarization process where tungsten (W) and carbon (C) are present in the elemental mapping image corresponds to the region where tungsten carbide grains 1 are present. The region shown in gray to black in the image after the binarization process where cobalt (Co) is present in the elemental mapping image corresponds to the region where binder phase 2 is present.

(G1) In the image after the binarization process, one rectangular measurement field of 24.9 μm×18.8 μm is set. Using the above image analysis software, the respective area percentages of tungsten carbide grains 1 and binder phase 2 are measured with the area of the entire measurement field as the denominator.

(H1) The measurement of the above (G1) is performed at five different measurement fields that are not overlapped with each other. In the present specification, the average of the area percentages of tungsten carbide grains 1 in the five measurement fields corresponds to the content [% by volume] of tungsten carbide grains 1 in cemented carbide [2] 3, and the average of the area percentages of binder phase 2 in the five measurement fields corresponds to the content [% by volume] of binder phase 2 in cemented carbide 3.

In the case where cemented carbide 3 comprises other phases in addition to tungsten carbide grains 1 and binder phase 2, the content of the other phases in cemented carbide 3 can be obtained by subtracting the content [% by volume] of tungsten carbide grains 1 and the content [% by volume] of binder phase 2 as measured in the above procedure from the entire cemented carbide 3 (100% by volume).

As far as the applicant has measured, it has been confirmed that, as long as measurement is performed on the same sample, even if the cut-out location for the cross-section of cemented carbide 3 is arbitrarily set, the region to be imaged described in the above (C1) is arbitrarily set on the cross-section, and the measurement of the content of tungsten carbide grains 1 and the content of binder phase 2 in cemented carbide 3 is performed multiple times according to the above procedure, the variation in measurement results was small and not arbitrary.

<<Binder Phase>>

Binder phase 2 contains cobalt, and cemented carbide 3 contains 1.0% by mass or more of cobalt. As a result of this, excellent toughness can be imparted to cemented carbide 3. Note that binder phase 2 may contain 50% by mass or more of cobalt, may contain 60% by mass or more of cobalt, may contain 70% by mass or more of cobalt, may contain 80% by mass or more of cobalt, may contain 90% by mass or more of cobalt, or may contain 95% by mass or more of cobalt. Binder phase 2 may be composed of cobalt. Alternatively, binder phase 2 may be composed of cobalt and a first element described later. Also, cobalt in cemented carbide 3 may be present only in binder phase 2. The lower limit of the content of cobalt in cemented carbide 3 may be 2.0% by mass or more, may be 3.0% by mass or more, or may be 4.0% by mass or more. The upper limit of the content of cobalt in cemented carbide 3 may be 20% by mass or less, may be 15% by mass or less, may be 12% by mass or less, or may be 10% by mass or less. Cemented carbide 3 may contain 1.0% by mass or more and 20% by mass or less of cobalt, may contain 2.0% by mass or more and 15% by mass or less of cobalt, or may contain 3.0% by mass or more and 12% by mass or less of cobalt.

A method for measuring the content of cobalt in cemented carbide 3 is as follows. At first, by the same method as (A1) to (C1) of the method for measuring the content of tungsten carbide grains 1 and the content of binder phase 2 in cemented carbide 3 described above, the region to be imaged is set. Next, the region to be imaged is analyzed using SEM-EDX to identify the distribution of the elements identified in the above (B1) in the region to be imaged, and an elemental mapping image is obtained while at the same time identifying the content of cobalt in cemented carbide 3. Note that a method for measuring the "cobalt content in binder phase 2" is as follows. At first, by the same method as (A1) to (F1) of the method for measuring the content of tungsten carbide grains 1 and the content of binder phase 2 in cemented carbide 3 described above, the region where binder phase 2 is present is identified on the image after the binarization process. Next, the region where binder phase 2 is present is analyzed using SEM-EDX to measure the "cobalt content in binder phase 2". Also, a method for identifying "cobalt in cemented carbide 3 is present only in binder phase 2" is as follows. At first, by the same method as (A1) to (F1) of the method for measuring the content of tungsten carbide grains 1 and the content of binder phase 2 in cemented carbide 3 described above, the region where tungsten carbide grains 1 are present and the region where binder phase 2 is present are identified on the image after the binarization process. Next, based on the elemental mapping image, as well as the region where tungsten carbide grains 1 are present and the region where binder phase 2 is present, "cobalt in cemented carbide 3 is present only in binder phase 2" is identified.

As far as the applicant has measured, it has been confirmed that, as long as measurement is performed on the same sample, even if the cut-out location for the cross-section of cemented carbide 3 and the region to be imaged described in the above (C1) are arbitrarily set, and the above measurement is performed multiple times according to the above procedure, the variation in measurement results was small and not arbitrary.

Binder phase 2 may further contain a first element, and the first element may be at least one element selected from the group consisting of silicon, phosphorus, germanium, tin, rhenium, ruthenium, osmium, iridium, and platinum. As a result of this, it is possible to provide cemented carbide 3 that can further extend the tool life of cutting tools, even in high speed processing of materials with particularly high hardness.

The content of the first element in cemented carbide 3 may be 0.01% by mass or more and 1.0% by mass or less. As a result of this, binder phase 2 can have more excellent hardness and more excellent toughness in combination. Note that the content of the first element in binder phase 2 may be 50% by mass or less, may be 40% by mass or less, may be 30% by mass or less, may be 20% by mass or less, may be 10% by mass or less, or may be 5% by mass or less. The first element in cemented carbide 3 may be present only in binder phase 2. The lower limit of the content of the first element in cemented carbide 3 may be 0.01% by mass or more, may be 0.04% by mass or more, or may be 0.1% by mass or more. The upper limit of the content of the first element in cemented carbide 3 may be 1.0% by mass or less, may be 0.8% by mass or less, or may be 0.6% by mass or less. The content of the first element in cemented carbide 3 may be 0.04% by mass or more and 0.8% by mass or less, or may be 0.1% by mass or more and 0.6% by mass or less.

A method for measuring the content of the first element in cemented carbide 3 is as follows. The measurement is carried out by the same method as the method for measuring the content of cobalt in cemented carbide 3, except that "cobalt" is replaced by "the first element". Note that a method for measuring the "content of the first element in binder phase 2" is as follows. The measurement is carried out by the same method as the method for measuring the "cobalt content in binder phase 2", except that "Next, . . . to measure the "cobalt' content in binder phase 2'" is replaced by "Next, . . . to measure the 'content of 'the first element' in binder phase 2'". Also, a method for identifying "the first element in cemented carbide 3 is present only in binder phase 2" is as follows. The measurement is carried out by the same method as the method for identifying "cobalt in cemented carbide 3 is present only in binder phase 2", except that "Next, . . . "cobalt' in cemented carbide 3 is present only in binder phase 2' is identified" is replaced by "Next, . . . "the first element' in cemented carbide 3 is present only in binder phase 2' is identified".

As far as the applicant has measured, it has been confirmed that, as long as measurement is performed on the same sample, even if the cut-out location for the cross-section of cemented carbide 3 and the region to be imaged described in the above (C1) are arbitrarily set, and the above measurement is performed multiple times according to the above procedure, the variation in measurement results was small and not arbitrary.

In binder phase 2, the percentage $\{M1/(M1+M2)\}\times100$ of the mass M1 of the first element to the sum M1+M2 of the mass M1 of the first element and the mass M2 of cobalt may be 1% or more and 6% or less. As a result of this, binder phase 2 can have more excellent hardness and more excellent toughness in combination, and therefore, it is possible to provide cemented carbide 3 that can further extend the tool life of cutting tools, even in high speed processing of materials with particularly high hardness. Here, the mass M1 of the first element means, in the case where the binder phase contains two or more first elements, the total mass of all first elements. The lower limit of the percentage $\{M1/(M1+M2)\}\times100$ may be 1% or more, may be 2% or more, or may be 3% or more. The upper limit of the percentage $\{M1/(M1+M2)\}\times100$ may be 6% or less, may be 5% or less, or may be 4% or less. The percentage $\{M1/(M1+M2)\}\times100$ may be 2% or more and 5% or less, or may be 3% or more and 4% or less.

A method for measuring the above percentage $\{M1/(M1+M2)\}\times100$ is as follows. By the same method as (A1) to (F1) of the method for measuring the content of tungsten carbide grains 1 and the content of binder phase 2 in cemented carbide 3 described above, the region where binder phase 2 is present is identified on the image after the binarization process. The region where binder phase 2 is present is analyzed using SEM-EDX to measure the cobalt content and first element content in binder phase 2, and based on them, the percentage $\{M1/(M1+M2)\}\times100$ is calculated. The above measurement is performed at five different measurement fields that are not overlapped with each other. In the present specification, the average of the percentages $\{M1/(M1+M2)\}\times100$ in the five measurement fields corresponds to "the percentage $\{M1/(M1+M2)\}\times100$" in binder phase 2.

As far as the applicant has measured, it has been confirmed that, as long as measurement is performed on the same sample, even if the cut-out location for the cross-section of cemented carbide 3 and the region to be imaged described in the above (C1) are arbitrarily set, and the measurement of the percentage $\{M1/(M1+M2)\}\times100$ is performed multiple times according to the above procedure, the variation in measurement results was small and not arbitrary.

<Hardness of Binder Phase>

The percentage $(H2/H1)\times100$ of the hardness of binder phase 2 at 600° C., H2 GPa, to the hardness at 25° C., H1 GPa, as measured by a nanoindenter method is 25% or more. As a result of this, a "decrease in the hardness of cemented carbide 3" associated with the change from 25° C. conditions (in other words, room temperature conditions) to 600° C. conditions (in other words, high temperature conditions) can be suppressed. The lower limit of the percentage $(H2/H1)\times100$ may be 50% or more, may be 60% or more, or may be 70% or more. The upper limit of the percentage $(H2/H1)\times100$ may be 85% or less, may be 80% or less, may be 75% or less, or may be 61% or less. The percentage $(H2/H1)\times100$ may be 25% or more and 85% or less, may be 50% or more and 80% or less, or may be 60% or more and 75% or less.

The hardness H1 may be 7.0 GPa or more. As a result of this, cemented carbide 3 can have more excellent abrasion resistance. The lower limit of the hardness H1 may be 7.0

GPa or more, may be 7.1 GPa or more, or may be 7.2 GPa or more. The upper limit of the hardness H1 may be 8.2 GPa or less, may be 8.0 GPa or less, or may be 7.8 GPa or less. The hardness H1 may be 7.0 GPa or more and 8.2 GPa or less, may be 7.1 GPa or more and 8.0 GPa or less, or may be 7.2 GPa or more and 7.8 GPa or less.

The hardness H2 may be 1.8 GPa or more. As a result of this, cemented carbide 3 can have more excellent abrasion resistance. The lower limit of the hardness H2 may be 1.8 GPa or more, may be 1.9 GPa or more, or may be 2.0 GPa or more. The upper limit of the hardness H2 may be 4.0 GPa or less, may be 3.9 GPa or less, or may be 3.7 GPa or less. The hardness H2 may be 1.8 GPa or more and 4.0 GPa or less, may be 1.9 GPa or more and 3.9 GPa or less, or may be 2.0 GPa or more and 3.7 GPa or less.

The above hardness H1 GPa and the above hardness H2 GPa are measured by a nanoindenter method ("Hysitron TI 980 TriboIndenter" manufactured by Bruker). The nanoindenter method is a method in accordance with ISO 14577 and is carried out under the following conditions: the measurement load is 0.5 mN, the loading time is 0.1 seconds, the load holding time is 0.1 seconds, and the unloading time is 0.1 seconds. The measurement subject is each of arbitrary ten binder phases 2 in total exposed by polishing the surface of cemented carbide 3 using a cross section polisher (CP) processing device ("IB-19500CP Cross Section Polisher" ™ manufactured by JEOL Ltd.). The average value of the respective hardnesses of the ten binder phases 2 in total, measured under the conditions of 25° C., is defined as the above hardness H1 GPa. Also, the average value of the respective hardnesses of the ten binder phases 2 in total, measured under the conditions of 600° C., is defined as the above hardness H2 GPa.

As far as the applicant has measured, it has been confirmed that, as long as measurement is performed on the same sample, even if the ten binder phases 2 are arbitrarily set and the measurement of the hardness of binder phase 2 is performed multiple times, the variation in measurement results was small and not arbitrary.

<<Tungsten Carbide Grains>>

In Embodiment 1, tungsten carbide grains 1 include at least any of "pure WC grains (including WC not containing any impurity elements, as well as WC in which the content of impurity elements is below the detection limit)" and "WC grains in which impurity elements are intentionally or inevitably contained therein to the extent that the effects of the present disclosure are not impaired". The content of impurities in the tungsten carbide grains (in the case where there are two or more elements constituting the impurities, their total content) is less than 0.1% by mass. The content of the impurity elements in the tungsten carbide grains is measured by inductively coupled plasma (ICP) emission spectroscopy (measurement device: "ICPS-8100" ™ manufactured by Shimadzu Corporation).

In Embodiment 1, the average grain size of tungsten carbide grains 1 is not particularly restricted. The average grain size of tungsten carbide grains 1 can be, for example, 0.5 μm or more and 3 μm or less. It has been confirmed that cemented carbide 3 of Embodiment 1 can have a long tool life regardless of the average grain size of tungsten carbide grains 1.

<Application of Cemented Carbide>

Cemented carbide 3 of the present embodiment may be used for cutting tools. Examples of the cutting tools include cutting tools for general purpose processing. More specific examples thereof include cutting tools such as a drill, an end mill, an indexable cutting insert for drills, an indexable cutting insert for end mills, an indexable cutting insert for milling, an indexable cutting insert for turning, a metal saw, a gear cutting tool, a reamer, and a tap.

Embodiment 2: Method for Producing Cemented Carbide

The cemented carbide of the present embodiment can be produced by performing a raw material powder preparation step, a mixing step, a molding step, a sintering step, a first cooling step, a heating step, a hot isostatic pressing (HIP) step, and a second cooling step in the order described above. Each step will be described below.

<Preparation Step>

The preparation step is a step of preparing raw material powders of the materials that constitute the cemented carbide. Examples of the raw material powders include a tungsten carbide powder (hereinafter, also referred to as "WC powder") and a cobalt (Co) powder. In addition to these raw material powders, a first element powder, a niobium carbide (NbC) powder, a tungsten tantalum carbide (TaC) powder, a titanium carbonitride (TiCN) powder, a zirconium carbide (ZrC) powder, and the like can be prepared. As these raw material powders, those commercially available can be used. The average grain size of these raw material powders is not particularly restricted, and it can be 0.5 to 2 μm, for example. The average grain size of the raw material powders means an average grain size measured by the Fisher Sub-Sieve Sizer (FSSS) method. The average grain size is measured using "Sub-Sieve Sizer Model 95" ™ manufactured by Fisher Scientific International, Inc.

<Mixing Step>

The mixing step is a step of mixing each raw material powder prepared in the preparation step at a predetermined proportion. A mixed powder in which each raw material powder is mixed is obtained by the mixing step. The mixing proportion of each raw material powder is adjusted as appropriate depending on the composition of the target cemented carbide. The first element powder may be used as a raw material powder. As a result of this, the first element is sufficiently solid-solved in the binder phase, which in turn makes it easier for the cemented carbide to have the desired "hardness of the binder phase at 25° C. as measured by a nanoindenter method". From the viewpoint of setting the total of the content of the tungsten carbide grains and the content of the binder phase within the desired range, the total content of powders other than the WC powder, Co powder, and the first element powder may be less than 5% by mass in the mixed powder. By adjusting the amount of each raw material powder to be charged as appropriate, the respective contents of the binder phase and WC grains can be set within the desired ranges.

For the mixing of each raw material powder, conventionally known mixing methods such as an attritor, a ball mill, and a bead mill can be used. The mixing conditions used can also be conventionally known conditions. The mixing time can be 2 hours or longer and 20 hours or shorter, for example.

After the mixing step, the mixed powder may be granulated as necessary. By granulating the mixed powder, it is easy to fill a die or mold with the mixed powder during the molding step described later. Known granulation methods can be applied for the granulation, and for example, a commercially available granulator such as a spray dryer can be used.

<Molding Step>

The molding step is a step of molding the mixed powder obtained in the mixing step into a shape for cutting tools to obtain a molded body. The molding method and molding conditions in the molding step are not particularly restricted as long as general methods and conditions may be employed.

<Sintering Step>

The sintering step is a step of sintering the molded body obtained in the molding step to obtain a cemented carbide intermediate. The sintering conditions in the present embodiment are as follows. The molded body is heated to 1360° C. and held at 1360° C. for 1 hours.

<First Cooling Step>

The first cooling step is a step of cooling the cemented carbide intermediate. More specifically, the cemented carbide intermediate is cooled to 1000° C. Although the cooling rate is not particularly restricted, it may be, for example, 20° C./min.

<Heating Step>

The heating step is a step of heating the cemented carbide intermediate. More specifically, the temperature of heating is 1200° C. and the holding time at this temperature is 0.25 hours.

<HIP Step>

The HIP step is a step of performing a HIP treatment on the cemented carbide intermediate. The conditions for the HIP step in the present embodiment are as follows. The cemented carbide intermediate is held under the conditions where the pressure is 100 MPa for 2 hours.

<Second Cooling Step>

The second cooling step is a step of cooling the cemented carbide intermediate. More specifically, the cemented carbide intermediate is cooled to 800° C. The cooling rate is 20° C./min. As a result of this, the cemented carbide of Embodiment 1 can be obtained.

<Characteristics of Method for Producing Cemented Carbide of the Present Embodiment>

In the present embodiment, the sintering step is carried out by heating the molded body to 1360° C. and holding it at 1360° C. for 1 hours. Furthermore, the first cooling step is carried out by cooling the cemented carbide intermediate to 1000° C. Furthermore, the heating step is carried out under the conditions where the temperature is 1200° C. and the holding time is 0.25 hours. Furthermore, the HIP step is carried out under the conditions where the pressure is 100 MPa and the time is 2 hours. Furthermore, the second cooling step is carried out by setting the cooling rate until 800° C. to 20° C./min. By these steps, the cemented carbide can be produced in which the percentage (H2/H1)×100 of the hardness of the binder phase at 600° C., H2 GPa, to the hardness at 25° C., H1 GPa, as measured by a nanoindenter method is 25% or more. The fact that the cemented carbide of the present disclosure can be realized by such sintering conditions, first cooling step, heating step, HIP step, and second cooling step has been newly found by the present inventors as a result of careful examination.

[Note 1]

In the cemented carbide of Embodiment 1, the nanoindenter method is a method in accordance with ISO 14577 and may be carried out under the following conditions: the measurement load is 0.5 mN, the loading time is 0.1 seconds, the load holding time is 0.1 seconds, and the unloading time is 0.1 seconds.

EXAMPLES

The present embodiment will be described more specifically with reference to examples. However, the present embodiment is not limited by these examples.

<<Production of Cemented Carbide>>

Cemented carbides according to Samples 1 to 20 and 101 to 114 were produced by carrying out the following steps in the following order.

<Preparation Step>

As the raw material powders, a WC powder (average grain size: 1 μm), a Co powder (average grain size: 1 μm), a first element powder, and a TiCN powder (average grain size: 1 μm) were prepared. As the first element powder, a Si powder (average grain size: 1 μm), a Ge powder (average grain size: 1 μm), a Sn powder (average grain size: 1 μm), an Os powder (average grain size: 1 μm), an Ir powder (average grain size: 1 μm), a Pt powder (average grain size: 1 μm), a P powder (average grain size: 1 μm), a Re powder (average grain size: 1 μm), and a Ru powder (average grain size: 1 μm) were prepared.

<Mixing Step>

Each raw material powder was mixed in the proportion described in Table 1 and Table 2 for 10 hours using an attritor to obtain a mixed powder.

<Molding Step>

The mixed powder was subjected to press molding or extrusion molding to obtain a round bar-shaped molded body.

<Sintering Step>

The molded body was heated to the temperature described in Table 1 and Table 2 and held at a state of that temperature for the holding time described in Table 1 and Table 2, thereby obtaining a cemented carbide intermediate.

<First Cooling Step>

The cemented carbide intermediate was cooled to the temperatures described in Table 3 and Table 4. Note that, in the case where "-" is described in the "Temperature [° C.]" column of the "First cooling step" column, it means that the "First cooling step" was not carried out.

<Heating Step>

The heating step was carried out on the cemented carbide intermediate under the conditions described in Table 3 and Table 4. Note that, in the case where "-" is described in each of the "Temperature [° C.]" column and the "Holding time [hours]" column in the "Heating step" column, it means that the "Heating step" was not carried out.

<HIP Step>

A HIP treatment was carried out on the cemented carbide intermediate under the conditions described in Table 3 and Table 4.

<Second Cooling Step>

The cemented carbide intermediate after the HIP step was cooled to 800° C. at the cooling rate described in Table 3 and Table 4, thereby obtaining a cemented carbide.

By the above procedure, the cemented carbides according to Samples 1 to 20 and 101 to 114 were produced.

[Table 1]

TABLE 1

| | Mixing step | | | | | Sintering step | |
|---|---|---|---|---|---|---|---|
| Sample No. | WC powder [% by mass] | Co powder [% by mass] | First element powder [% by mass] | Type of first element | TiCN powder [% by mass] | Temperature [° C.] | Holding time [hours] |
| 1 | Remainder | 10 | 0.6 | Si | 0 | 1360 | 1 |
| 2 | Remainder | 10 | 0.6 | Ge | 0 | 1360 | 1 |
| 3 | Remainder | 10 | 0.1 | Sr | 0 | 1360 | 1 |
| 4 | Remainder | 10 | 0.6 | Os | 0 | 1360 | 1 |
| 5 | Remainder | 10 | 0.6 | Pt | 0 | 1360 | 1 |

TABLE 1-continued

| Sample No. | Mixing step: WC powder [% by mass] | Co powder [% by mass] | First element powder [% by mass] | Type of first element | TiCN powder [% by mass] | Sintering step: Temperature [° C.] | Holding time [hours] |
|---|---|---|---|---|---|---|---|
| 6 | Remainder | 10 | 0.6 | Si | 4 | 1360 | 1 |
| 7 | Remainder | 10 | 0.6 | Si | 4.3 | 1360 | 1 |
| 8 | Remainder | 10 | 0.2 | Re | 4 | 1360 | 1 |
| 9 | Remainder | 1.00 | 0.01 | Si | 0 | 1360 | 1 |
| 10 | Remainder | 10 | 0.5 | P | 0 | 1360 | 1 |
| 11 | Remainder | 10 | 0.5 | P | 0 | 1360 | 1 |
| 12 | Remainder | 10 | 0.1 | Si | 0 | 1360 | 1 |
| 13 | Remainder | 1.00 | 0.01 | P | 0 | 1360 | 1 |
| 14 | Remainder | 10 | 0.62 | Si | 0 | 1360 | 1 |
| 15 | Remainder | 10 | 0.4 | Ge | 0 | 1360 | 1 |
| 16 | Remainder | 10 | 0.1 | Ir | 0 | 1360 | 1 |
| 17 | Remainder | 10 | 0.4 | Ru | 0 | 1360 | 1 |
| 18 | Remainder | 10 | 0.09 | Si | 0 | 1360 | 1 |
| 19 | Remainder | 10 | 0.6 | Re | 0 | 1360 | 1 |
| 20 | Remainder | 10 | 0.65 | Ru | 0 | 1360 | 1 |

[Table 2]

TABLE 2

| Sample No. | Mixing step: WC powder [% by mass] | Co powder [% by mass] | First element powder [% by mass] | Type of first element | TiCN powder [% by mass] | Sintering step: Temperature [°C] | Holding time [hours] |
|---|---|---|---|---|---|---|---|
| 101 | Remainder | 1.00 | 0.01 | Os | 0 | 1360 | 1 |
| 102 | Remainder | 10 | 0.6 | P | 0 | 1360 | 1 |
| 103 | Remainder | 10 | 0.6 | Si | 5 | 1360 | 1 |
| 104 | Remainder | 10 | 0 | — | 0 | 1380 | 1 |
| 105 | Remainder | 10 | 0.6 | Si | 0 | 1380 | 1 |
| 106 | Remainder | 10 | 0.6 | Ru | 0 | 1380 | 1 |
| 107 | Remainder | 10 | 0.6 | Re | 0 | 1380 | 1 |
| 108 | Remainder | 10 | 0.6 | Ge | 0 | 1380 | 1 |
| 109 | Remainder | 10 | 0.6 | Sn | 0 | 1380 | 1 |
| 110 | Remainder | 10 | 0.6 | Os | 0 | 1380 | 1 |
| 111 | Remainder | 10 | 0.6 | Ir | 0 | 1380 | 1 |
| 112 | Remainder | 10 | 0.6 | Pt | 0 | 1380 | 1 |
| 113 | Remainder | 10 | 0.6 | P | 0 | 1380 | 1 |
| 114 | Remainder | 0.95 | 0.01 | P | 0 | 1360 | 1 |

[Table 3]

TABLE 3

| Sample No. | First cooling step: Temperature [° C.] | Heating step: Temperature [° C.] | Heating step: Holding time [hours] | HIP step: Pressure of HIP [MPa] | HIP step: Time of HIP [hours] | Second cooling step: Cooling rate [° C./min] |
|---|---|---|---|---|---|---|
| 1 | 1000 | 1200 | 0.25 | 100 | 2 | 20 |
| 2 | 1000 | 1200 | 0.25 | 100 | 2 | 20 |
| 3 | 1000 | 1200 | 0.25 | 100 | 2 | 20 |
| 4 | 1000 | 1200 | 0.25 | 100 | 2 | 20 |
| 5 | 1000 | 1200 | 0.25 | 100 | 2 | 20 |
| 6 | 1000 | 1200 | 0.25 | 100 | 2 | 20 |
| 7 | 1000 | 1200 | 0.25 | 100 | 2 | 20 |
| 8 | 1000 | 1200 | 0.25 | 100 | 2 | 20 |
| 9 | 1000 | 1200 | 0.25 | 100 | 2 | 20 |
| 10 | 1000 | 1200 | 0.25 | 100 | 2 | 20 |
| 11 | 1000 | 1200 | 0.25 | 100 | 2 | 20 |
| 12 | 1000 | 1200 | 0.25 | 100 | 2 | 20 |

TABLE 3-continued

| Sample No. | First cooling step: Temperature [° C.] | Heating step: Temperature [° C.] | Heating step: Holding time [hours] | HIP step: Pressure of HIP [MPa] | HIP step: Time of HIP [hours] | Second cooling step: Cooling rate [° C./min] |
|---|---|---|---|---|---|---|
| 13 | 1000 | 1200 | 0.25 | 100 | 2 | 20 |
| 14 | 1000 | 1200 | 0.25 | 100 | 2 | 20 |
| 15 | 1000 | 1200 | 0.25 | 100 | 2 | 20 |
| 16 | 1000 | 1200 | 0.25 | 100 | 2 | 20 |
| 17 | 1000 | 1200 | 0.25 | 100 | 2 | 20 |
| 18 | 1000 | 1200 | 0.25 | 100 | 2 | 20 |
| 19 | 1000 | 1200 | 0.25 | 100 | 2 | 20 |
| 20 | 1000 | 1200 | 0.25 | 100 | 2 | 20 |

[Table 4]

TABLE 4

| Sample No. | First cooling step Temperature [° C.] | Heating step Temperature [° C.] | Heating step Holding time [hours] | HIP step Pressure of HIP [MPa] | HIP step Time of HIP [hours] | Second cooling step Cooling rate [° C./min] |
|---|---|---|---|---|---|---|
| 101 | 1000 | 1200 | 0.25 | 100 | 2 | 20 |
| 102 | 1000 | 1200 | 0.25 | 100 | 2 | 20 |
| 103 | 1000 | 1200 | 0.25 | 100 | 2 | 20 |
| 104 | — | — | — | 100 | 2 | 10 |
| 105 | — | — | — | 100 | 2 | 10 |
| 106 | — | — | — | 100 | 2 | 10 |
| 107 | — | — | — | 100 | 2 | 10 |
| 108 | — | — | — | 100 | 2 | 10 |
| 109 | — | — | — | 100 | 2 | 10 |
| 110 | — | — | — | 100 | 2 | 10 |
| 111 | — | — | — | 100 | 2 | 10 |
| 112 | — | — | — | 100 | 2 | 10 |
| 113 | — | — | — | 100 | 2 | 10 |
| 114 | 1000 | 1200 | 0.25 | 100 | 2 | 20 |

[Table 5]

TABLE 5

| Sample No. | Content of WC grains [% by volume] | Content of binder phase [% by volume] | Total [% by volume] | Hardness of binder phase H1 [GPa] | Hardness of binder phase H2 [GPa] | (H2/H1) × 100 [%] | Co content [% by mass] | First element content [% by mass] | {M1/(M1 + M2)} × 100 [%] | Cutting test Cutting length [m] |
|---|---|---|---|---|---|---|---|---|---|---|
| 1 | Remainder | 19.4 | 100 | 7.3 | 1.9 | 26 | 10 | 0.6 | 5.4 | 140 |
| 2 | Remainder | 17.7 | 100 | 7.4 | 2.2 | 30 | 10 | 0.6 | 5.5 | 135 |
| 3 | Remainder | 16.4 | 100 | 7.1 | 3.4 | 48 | 10 | 0.1 | 1.2 | 175 |
| 4 | Remainder | 16.7 | 100 | 7.4 | 2.7 | 37 | 10 | 0.6 | 5.6 | 145 |
| 5 | Remainder | 16.7 | 100 | 7.4 | 3.3 | 45 | 10 | 0.6 | 5.5 | 165 |
| 6 | Remainder | 16.1 | 89.6 | 7.8 | 2.7 | 35 | 10 | 0.6 | 5.6 | 145 |
| 7 | Remainder | 18.1 | 89 | 7.2 | 2.3 | 32 | 10 | 0.6 | 5.6 | 145 |
| 8 | Remainder | 15.4 | 90 | 7.1 | 2.1 | 30 | 10 | 0.2 | 2.1 | 140 |
| 9 | Remainder | 1.8 | 100 | 7.0 | 3.3 | 47 | 1.0 | 0.01 | 1.1 | 170 |
| 10 | Remainder | 19.6 | 100 | 7.3 | 3.4 | 46 | 10 | 0.5 | 4.9 | 170 |
| 11 | Remainder | 20.0 | 100 | 7.1 | 2.3 | 32 | 10 | 0.6 | 5.5 | 175 |
| 12 | Remainder | 16.8 | 100 | 7.0 | 1.8 | 25 | 10 | 0.1 | 1.1 | 110 |
| 13 | Remainder | 1.8 | 100 | 7.1 | 3.6 | 50 | 1.0 | 0.01 | 1.0 | 190 |
| 14 | Remainder | 20.0 | 100 | 7.2 | 4.4 | 61 | 10 | 0.62 | 5.8 | 210 |
| 15 | Remainder | 17.2 | 100 | 7.2 | 3.7 | 52 | 10 | 0.4 | 3.8 | 205 |
| 16 | Remainder | 16.3 | 100 | 7.0 | 2.8 | 40 | 10 | 0.1 | 1.0 | 160 |
| 17 | Remainder | 16.6 | 100 | 6.9 | 2.4 | 35 | 10 | 0.4 | 3.8 | 140 |
| 18 | Remainder | 16.7 | 100 | 7.0 | 2.5 | 36 | 10 | 0.09 | 0.9 | 135 |
| 19 | Remainder | 16.7 | 100 | 7.3 | 2.9 | 40 | 10 | 0.6 | 5.8 | 155 |
| 20 | Remainder | 17 | 100 | 7.5 | 2.2 | 29 | 10 | 0.65 | 6.1 | 130 |

[Table 6]

TABLE 6

| Sample No. | Content of WC grains [% by volume] | Content of binder phase [% by volume] | Total [% by volume] | Hardness of binder phase H1 [GPa] | Hardness of binder phase H2 [GPa] | (H2/H1) × 100 [%] | Co content [% by mass] | First element content [% by mass] | {M1/(M1 + M2)} × 100 [%] | Cutting test Cutting length [m] |
|---|---|---|---|---|---|---|---|---|---|---|
| 101 | Remainder | 1.7 | 100 | 7.1 | 2.7 | 38 | 1.0 | 0.01 | 1.0 | 65 |
| 102 | Remainder | 20.2 | 100 | 7.4 | 3.1 | 42 | 10 | 0.6 | 5.7 | 65 |
| 103 | Remainder | 17.8 | 88 | 7.5 | 3.2 | 42 | 10 | 0.6 | 5.6 | 70 |
| 104 | Remainder | 16.2 | 100 | 7.0 | 1.3 | 18 | 10 | 0 | 0 | 60 |
| 105 | Remainder | 16.8 | 100 | 7.5 | 1.7 | 22 | 10 | 0.6 | 5.4 | 65 |
| 106 | Remainder | 16.5 | 100 | 7.1 | 1.6 | 23 | 10 | 0.6 | 5.5 | 65 |
| 107 | Remainder | 16.8 | 100 | 7.2 | 1.6 | 22 | 10 | 0.6 | 5.6 | 60 |
| 108 | Remainder | 16.9 | 100 | 7.3 | 1.5 | 21 | 10 | 0.6 | 5.6 | 60 |
| 109 | Remainder | 16.8 | 100 | 7.3 | 1.7 | 23 | 10 | 0.6 | 5.7 | 65 |
| 110 | Remainder | 16.8 | 100 | 7.0 | 1.4 | 20 | 10 | 0.6 | 5.4 | 60 |
| 111 | Remainder | 16.9 | 100 | 7.1 | 1.6 | 23 | 10 | 0.6 | 5.5 | 60 |
| 112 | Remainder | 16.7 | 100 | 7.2 | 1.4 | 19 | 10 | 0.6 | 5.6 | 55 |
| 113 | Remainder | 16.8 | 100 | 7.1 | 1.5 | 21 | 10 | 0.6 | 5.6 | 55 |
| 114 | Remainder | 1.8 | 100 | 7.0 | 2.8 | 40 | 0.9 | 0.01 | 4.9 | 65 |

<<Characteristic Evaluation of Cemented Carbide>>

<Content of Tungsten Carbide Grains>

For the cemented carbide according to each sample, the content of the tungsten carbide grains was determined by the method described in Embodiment 1. The results obtained are described in the "Content of WC grains [% by volume]" column of Table 5 and Table 6. Note that "Remainder" being described in the "Content of WC grains [% by volume]" column of Table 5 and Table 6 means that the content of the tungsten carbide grains is a numerical value equal to the numerical value obtained by subtracting the numerical value described in the "Content of binder phase [% by volume]" column of Table 5 and Table 6 from the numerical value described in the "Total [% by volume]" column of Table 5 and Table 6.

<Content of Binder Phase>

For the cemented carbide according to each sample, the content of the binder phase was determined by the method described in Embodiment 1. The results obtained are described in the "Content of binder phase [% by volume]" column of Table 5 and Table 6.

<Hardness of Binder Phase>

For the cemented carbide according to each sample, the hardness of the binder phase H1 was determined by the method described in Embodiment 1. The results obtained are described in the "hardness of binder phase H1 [GPa]" column of Table 5 and Table 6. Also, for the cemented carbide according to each sample, the hardness of the binder phase H2 was determined by the method described in Embodiment 1. The results obtained are described in the "hardness of binder phase H2 [GPa]" column of Table 5 and Table 6.

<Content of Cobalt in Cemented Carbide>

For the cemented carbide according to each sample, the content of cobalt in the cemented carbide was determined by the method described in Embodiment 1. The results obtained are described in the "Co content [% by mass]" column of Table 5 and Table 6. Note that, for the cemented carbide according to each sample, "cobalt in cemented carbide 3 is present only in binder phase 2" was confirmed by the method described in Embodiment 1.

<Content of First Element in Cemented Carbide>

For the cemented carbide according to each sample, the content of the first element in the cemented carbide was determined by the method described in Embodiment 1. The results obtained are described in the "First element content [% by mass]" column of Table 5 and Table 6. Note that, for the cemented carbide according to each sample, in the case where the "First element content [% by mass]" is not 0% by mass, "the first element in cemented carbide 3 is present only in binder phase 2" was confirmed by the method described in Embodiment 1.

$$<\{M1/(M1+M2)\}\times 100>$$

For the cemented carbide according to each sample, {M1/(M1+M2)}×100 was determined by the method described in Embodiment 1. The results obtained are described in the "{M1/(M1+M2)}×100 [%]" column of Table 5 and Table 6.

<<Cutting Test>>

At first, by processing the round bar composed of the cemented carbide according to each sample, three end mills (GSXB 20000 type) with a drill diameter of φ8 mm were produced as a cutting tool for each sample. Next, using the end mills of each sample, cutting was performed under the following cutting conditions, and the cutting distance until 0.05 mm of abrasion occurred in the end mills was measured. For each sample, the average value of the respective cutting distances of the three end mills was calculated, thereby obtaining the cutting length. The results obtained are each described in the "Cutting length [m]" column of Table 5 and Table 6. Note that a longer cutting length indicates a longer tool life.

<Cutting Conditions>

Workpiece: SKD11 (material with high hardness)
Cutting speed Vc: 250 m/min
Feed per drill Fz: 0.15 mm/t
Cut depth Ap: 0.5 mm
Cutting fluid: not used (dry)

The above cutting conditions correspond to high speed processing of materials with high hardness.

The cemented carbides according to Samples 1 to 20 correspond to Examples. The cemented carbides according to Samples 101 to 114 correspond to Comparative Examples. From the results of Table 5 and Table 6, it was found that the cemented carbides according to Samples 1 to 20 enable a longer service life of tools, even in the case where they are used as a material for cutting tools for high speed processing of materials with high hardness, compared to the cemented carbides according to Samples 101 to 114.

From the above, it was found that the cemented carbides according to Samples 1 to 20 enable a longer service life of tools, even in the case where they are used as a material for cutting tools for high speed processing of materials with high hardness.

Although the embodiments and Examples of the present disclosure have been described above, it has been planned from the beginning that the configurations of the embodiments and Examples described above may be appropriately combined or modified in various ways.

It should be understood that the embodiments and Examples disclosed herein are illustrative in all respects and are not restrictive. The scope of the present invention is defined not by the above-described embodiments and Examples but by the claims, and is intended to include meanings equivalent to the claims and all modifications within the scope.

REFERENCE SIGNS LIST

1 Tungsten carbide grain; 2 Binder phase; 3 Cemented carbide.

The invention claimed is:

1. A cemented carbide comprising a plurality of tungsten carbide grains and a binder phase, wherein the cemented carbide comprises the tungsten carbide grains and the binder phase in a total of 89% by volume or more, the cemented carbide comprises 1.8% by volume or more and 20.0% by volume or less of the binder phase, the binder phase contains cobalt and a first element, the first element being silicon, the cemented carbide contains 1.0% by mass or more of cobalt, and a percentage (H2/H1)×100 of a hardness of the binder phase at 600° C., H2 GPa, to a hardness at 25° C., H1 GPa, as measured by a nanoindenter method is 25% or more.

2. The cemented carbide according to claim 1, wherein the percentage (H2/H1)×100 is 50% or more.

3. The cemented carbide according to claim 1, wherein the hardness H1 is 7.0 GPa or more.

4. The cemented carbide according to claim 1, wherein, in the binder phase, a percentage $\{M1/(M1+M2)\}\times100$ of a mass M1 of the first element to a sum M1+M2 of the mass M1 of the first element and a mass M2 of cobalt is 1% or more and 6% or less.

5. The cemented carbide according to claim 1, wherein the cemented carbide is prepared by:

preparing raw material powders of materials that constitute the cemented carbide, mixing each raw material powder at a predetermined proportion to form a mixed powder, molding the mixed powder into a shape for cutting tools to obtain a molded body, sintering the molded body to obtain a cemented carbide intermediate, performing a first cooling on the cemented carbide intermediate, heating the cemented carbide intermediate after performing the first cooling, performing a hot isostatic pressing (HIP) on the cemented carbide intermediate after performing the heating, and performing a second cooling on the cemented carbide intermediate after performing the HIP.

6. The cemented carbide according to claim 1, wherein, in the binder phase, a percentage $\{M1/(M1+M2)\}\times100$ of a mass M1 of the first element to a sum M1+M2 of the mass M1 of the first element and a mass M2 of cobalt is 1% or more and 4.5% or less.

* * * * *